US009290873B2

(12) United States Patent
Ikeba et al.

(10) Patent No.: US 9,290,873 B2
(45) **Date of Patent: *Mar. 22, 2016**

(54) SEWING MACHINE, INFORMATION PROCESSING APPARATUS, AND NON-TRANSITORY COMPUTER-READABLE MEDIUM

(71) Applicant: Brother Kogyo Kabushiki Kaisha, Nagoya-shi, Aichi-ken (JP)

(72) Inventors: Masae Ikeba, Handa (JP); Masahiro Mizuno, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 460 days.

This patent is subject to a terminal disclaimer.

(21) Appl. No.: 13/682,177

(22) Filed: Nov. 20, 2012

(65) Prior Publication Data

US 2013/0133561 A1 May 30, 2013

(30) Foreign Application Priority Data

Nov. 29, 2011 (JP) ..... 2011-260580

(51) Int. Cl.
*D05B 21/00* (2006.01)
*D05C 5/06* (2006.01)
*D05B 19/10* (2006.01)

(52) U.S. Cl.
CPC . *D05C 5/06* (2013.01); *D05B 19/10* (2013.01)

(58) Field of Classification Search
CPC ..... D05B 19/10
USPC ..... 112/102.5, 470.01, 470.03, 470.06, 112/470.09, 475.05; 700/136, 137, 138
See application file for complete search history.

(56) References Cited

U.S. PATENT DOCUMENTS

| | | | | |
|---|---|---|---|---|
| 5,255,620 | A * | 10/1993 | Sasano et al. | 112/102.5 |
| 5,390,615 | A * | 2/1995 | Sugimoto | 112/102.5 |
| 5,553,559 | A | 9/1996 | Inoue et al. | |
| 6,189,467 | B1 * | 2/2001 | Tomita | 112/102.5 |
| 6,600,966 | B1 * | 7/2003 | Bailie | 700/138 |
| 7,908,985 | B2 * | 3/2011 | Okuyama | 112/102.5 |
| 8,733,261 | B2 * | 5/2014 | Mizuno et al. | 112/102.5 |
| 8,897,907 | B2 * | 11/2014 | Ikeba | 700/138 |

FOREIGN PATENT DOCUMENTS

JP A-6-319879 11/1994

* cited by examiner

*Primary Examiner* — Tejash Patel
(74) *Attorney, Agent, or Firm* — Oliff PLC

(57) ABSTRACT

A sewing machine includes a processor and a memory. The memory stores a plurality of embroidery data which respectively corresponds to a plurality of embroidery patterns and computer-readable instructions. The instructions instruct the sewing machine to execute steps of selecting one of the plurality of embroidery data and sewing the embroidery pattern corresponding to the selected embroidery data. The instructions further instruct the sewing machine to execute steps of extracting, from the plurality of embroidery data, specific embroidery data, wherein the specific embroidery data is usable in combination with the selected embroidery data, and sewing the specific embroidery pattern based on the extracted specific embroidery data.

8 Claims, 14 Drawing Sheets

FIG. 4

21

| | |
|---|---|
| IDENTIFICATION NO. | D1 |
| SEWING-FINISHED-STATE INFORMATION | 0 |
| POSITION INFORMATION | UPPER MIDDLE AREA |
| COMBINATION INFORMATION | D2 |
| | D3 |
| | D4 |
| | D5 |

FIG. 5

22

| | |
|---|---|
| IDENTIFICATION NO. | D2 |
| SEWING-FINISHED-STATE INFORMATION | 0 |
| POSITION INFORMATION | CENTER MIDDLE AREA |
| COMBINATION INFORMATION | D1 |
| | D3 |
| | D4 |
| | D5 |

FIG. 6

23

| | |
|---|---|
| IDENTIFICATION NO. | D3 |
| SEWING-FINISHED-STATE INFORMATION | 0 |
| POSITION INFORMATION | CENTER LEFT AREA |
| COMBINATION INFORMATION | D1 |
| | D2 |
| | D4 |
| | D5 |

FIG. 7

24

| | |
|---|---|
| IDENTIFICATION NO. | D4 |
| SEWING-FINISHED-STATE INFORMATION | 0 |
| POSITION INFORMATION | LOWER MIDDLE AREA |
| COMBINATION INFORMATION | D1 |
| | D2 |
| | D3 |
| | D5 |

FIG. 8

25

| | |
|---|---|
| IDENTIFICATION NO. | D5 |
| SEWING-FINISHED-STATE INFORMATION | 0 |
| POSITION INFORMATION | CENTER RIGHT AREA |
| COMBINATION INFORMATION | D1 |
| | D2 |
| | D3 |
| | D4 |

SEWING MACHINE, INFORMATION PROCESSING APPARATUS, AND NON-TRANSITORY COMPUTER-READABLE MEDIUM

CROSS-REFERENCE TO RELATED APPLICATION

This application claims priority from JP2011-260580, filed on Nov. 29, 2011, the content of which is hereby incorporated by reference.

BACKGROUND

The present disclosure relates to a sewing machine that is capable of sewing embroidery pattern, an information processing apparatus, and a non-transitory computer-readable medium.

Conventionally, a sewing machine is known that is capable of sewing an embroidery pattern including a character, a symbol, and a picture to work cloth to which sewing is performed. The user selects one of a plurality of embroidery patterns registered in the sewing machine beforehand. Then, the sewing machine sews the selected embroidery pattern to the work cloth. The embroidery patterns are typically used independently of each other and highly decorative in many cases. In some cases, the user would like to combine a plurality of highly decorative embroidery patterns and sew more highly decorative embroidery (hereinafter referred to as "combined embroidery") to the work cloth. For example, another sewing machine is known that forms a mark denoting a reference position on the work cloth to facilitate alignment of a plurality of embroidery patterns to be sewed.

SUMMARY

To sew combined embroidery by using the sewing machine descried above, the user has needed to sew one of the embroidery patterns of the combined embroidery and then select the next embroidery pattern to be sewed. For example, this type of sewing machine has had a problem in that a lot of labor is required to select the embroidery patterns.

It is an object of the present disclosure to provide a sewing machine, an information processing apparatus, and a non-transitory computer-readable medium that enables, when sewing combined embroidery created by combining a plurality of mutually independent embroidery patterns, sewing one of the embroidery patterns and then automatically extracting embroidery data of any other embroidery pattern that can be used in combination with the one embroidery pattern.

A sewing machine according to a first aspect of the present disclosure includes a processor and a memory. The memory is configured to store a plurality of embroidery data and computer-readable instructions. The plurality of embroidery data respectively corresponds to a plurality of embroidery patterns. The computer-readable instructions instruct the sewing machine to execute steps including selecting one of the plurality of embroidery data, sewing the embroidery pattern corresponding to the selected embroidery data, extracting, from the plurality of embroidery data, specific embroidery data, wherein the specific embroidery data is usable in combination with the selected embroidery data, and sewing the specific embroidery pattern based on the extracted specific embroidery data.

An information processing apparatus according to a second embodiment of the present disclosure includes a processor and a memory. The memory is configured to store a plurality of embroidery data and computer-readable instructions. The plurality of embroidery data respectively correspond to a plurality of embroidery patterns. The computer-readable instructions instruct the information processing apparatus to execute steps including selecting one of the plurality of embroidery data, and extracting, from the plurality of embroidery data, specific embroidery data, wherein the specific embroidery data is usable in combination with the selected embroidery data.

A non-transitory computer-readable medium according to a third embodiment of the present disclosure stores computer-readable instructions. The computer-readable instructions instruct an information processing apparatus to execute steps including selecting one of a plurality of embroidery data which respectively correspond to a plurality of embroidery patterns, and extracting, from the plurality of embroidery data, specific embroidery data, wherein the specific embroidery data is usable in combination with the selected embroidery data.

BRIEF DESCRIPTION OF THE DRAWINGS

Embodiments will be described below in detail with reference to the accompanying drawings in which:

FIG. 4 is a conceptual diagram of a combination information table 21;

FIG. 5 is a conceptual diagram of a combination information table 22;

FIG. 6 is a conceptual diagram of a combination information table 23;

FIG. 7 is a conceptual diagram of a combination information table 24;

FIG. 8 is a conceptual diagram of a combination information table 25;

DETAILED DESCRIPTION OF THE EXEMPLARY EMBODIMENTS

Figure 1:
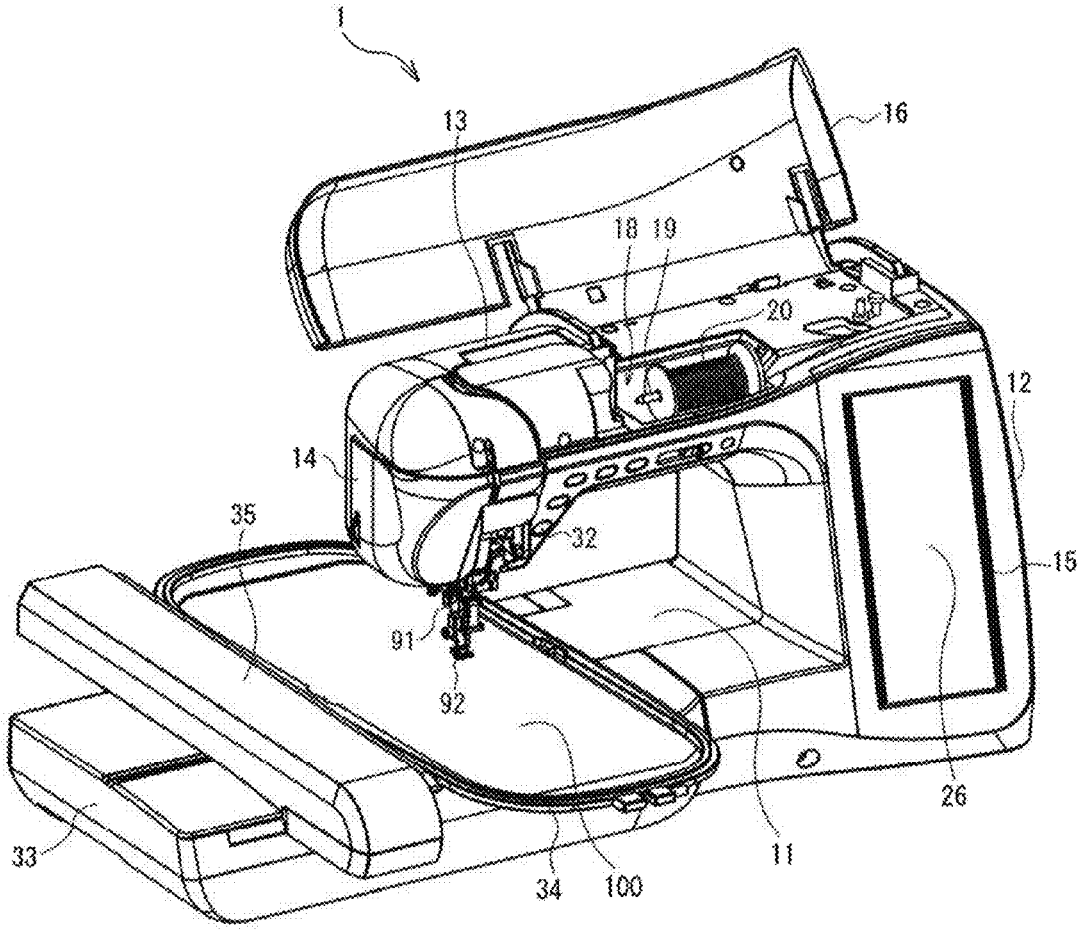
FIG. 1 is a perspective view of a sewing machine 1.

The following will describe a sewing machine 1 of one embodiment of the present disclosure with reference to the drawings. The drawings are used to describe technological features that can be employed by the present disclosure; therefore, configurations etc. of an apparatus described in the drawings are given just as examples for explanation without any intended limitation. In the following description, the lower right side, the upper left side, the upper right side, the lower left side, the lower side, and the upper side of FIG. 1 are respectively referred to as the front side, the rear side, the right side, the left side, the lower side, and the upper side. Namely, a surface on which a touch panel 26, which will be described later, is disposed is the front surface of the sewing machine 1. The longitudinal directions of a bed 11 and an arm 13 are the right-and-left direction of the sewing machine 1 and a side on which a pillar 12 is disposed is the right side. A direction in which the pillar 12 extends is the up-down direction of the sewing machine 1.

A physical configuration of the sewing machine 1 will be explained with reference to FIG. 1. The sewing machine 1 is provided with a bed 11, the pillar 12, the arm 13, and a head 14. The bed 11 extends in the left-right direction and is the base of the sewing machine 1. The pillar 12 extends upward from the right end of the bed 11. The arm 13 extends leftward from the upper end of the pillar 12, such that it is opposite the bed 11. The head 14 is connected to the left end of the arm 13. A needle plate (not shown) is provided in the top face of the bed 11. Below the needle plate (that is, inside the bed 11), a feed dog, a cloth feed mechanism, a shuttle mechanism, and a feed adjustment pulse motor 78 (see FIG. 3) which are not shown are provided. The feed dog may be driven by the cloth feed mechanism to transport work cloth at a predetermined feed rate. The amount of the feed by the feed dog may be adjusted by the feed adjustment pulse motor 78.

An embroidery frame 34 configured to hold work cloth 100 can be placed on the bed 11. The embroidery frame 34 including an inner frame and an outer frame has a known configuration to sandwich and hold the work cloth 100 between the inner frame and the outer frame. As an embroidery frame transport device 33 configured to transport the embroidery frame 34 has a known configuration, it will be described simply. The embroidery frame transport device 33 may be detachably attached to the bed 11. The embroidery frame transport device 33 has thereon a carriage 35 which extends in the front-and-rear direction. The carriage 35 has therein a frame holder (not shown) which the embroidery frame 34 can be attached to and detached from and a Y-axial transport mechanism (not shown) which transports the frame holder in the front-and-rear direction (Y direction). The Y-axial transport mechanism may be driven by a Y-axial motor 84 (see FIG. 3).

In the body of the embroidery frame transport device 33, an X-axial transport mechanism (not shown) is provided to transport the carriage 35 in the right-and-left direction (X direction). The X-axial transport mechanism may be driven by an X-axial motor 83 (see FIG. 3). As the carriage 35 is transported in the right-and-left direction (X direction), the embroidery frame 34 is transported in the right-and-left direction (X direction).

As the embroidery frame 34 is transported in the right-and-left direction (X direction) and the front-and-rear direction (Y direction), a needle bar (not shown) and the shuttle mechanism (not shown) are driven. As the needle bar and the shuttle mechanism are driven, a sewing needle (not shown) mounted to the needle bar (not shown) is used to sew an embroidery pattern into the work cloth 100 held by the embroidery frame 34. In the case of an ordinary utility stitch pattern other than embroidery patterns, it may be sewed as the work cloth 100 is moved by the feed dog in a state where the embroidery transport device 33 is detached from the bed 11.

A liquid crystal display (hereinafter referred to as "LCD") 15 that has a vertically rectangular shape is provided on the front face of the pillar 12. The LCD 15 may display an image containing various items such as command, illustration, set values and messages. A touch panel 26 is provided on the front face of the LCD 15. If the user presses the touch panel 26 by using his finger or a dedicated touch pen (which operations are hereinafter referred to as "panel operations"), a selected item is identified on the basis on a pressed position detected by the touch panel 26. By performing those panel operations, the user can select a pattern to be sewed or a command or the like to be executed.

A cover 16 that may open and close the top side of the arm 13 is attached to the arm 13. The cover 16 has therebelow, that is, roughly at the midsection in the arm 13, a concaved thread-containing portion 18 configured to house a thread spool 20. On an inner wall surface on the side of the pillar 12, the thread-containing portion 18 may contain a thread spool pin 19 which may project leftward toward the head 14. The thread spool 20 may contain an insertion hole (not shown). The thread spool 20 may be mounted in the thread-containing portion 18 in condition where the thread spool pin 19 is inserted through the insertion hole.

A needle thread (not shown) spooled around the thread spool 20 may be supplied from the thread spool 20 to a sewing needle (not shown) mounted to a needle bar (not shown) via a thread hook (not shown) provided on the head 14. The needle bar (not shown) may be driven to move up and down by a needle bar up-and-down movement mechanism (not shown) provided in the head 14. The needle bar up-and-down movement mechanism may be driven by a main shaft (not shown) which is driven rotationally by a sewing machine motor 79 (see FIG. 3). A presser bar 91 extends downward from the lower end of the head 14. To the presser bar 91, a presser foot 92 configured to press the work cloth 100 may be replaceably mounted. The arm 13 is provided with a plurality of operating switches such as a start/stop switch 32 on a lower front surface of the arm 13.

Figure 2:
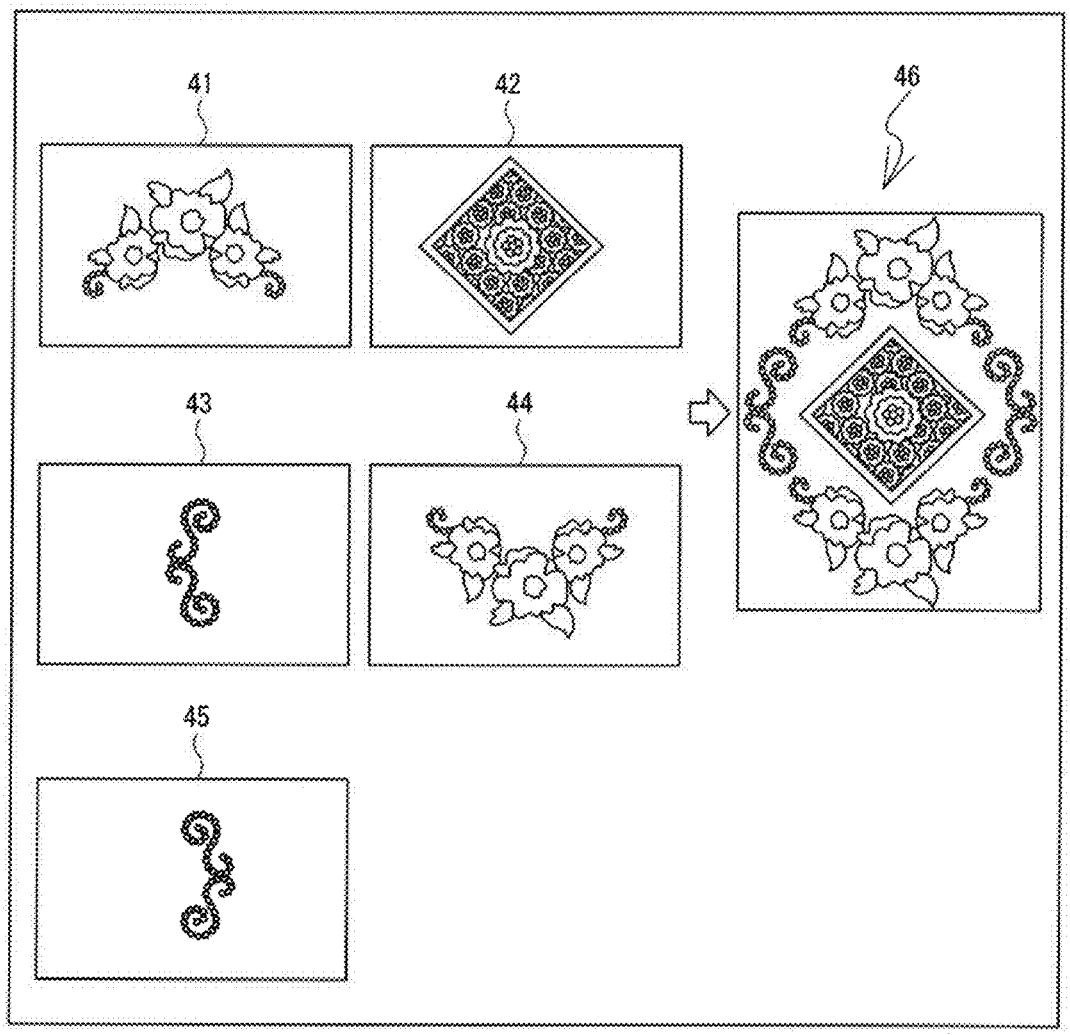
FIG. 2 is an explanatory view showing one example of creating composite embroidery 46 by combining patterns 41 to 45.

A composite embroidery which can be sewed by the sewing machine 1 will be explained with reference to FIG. 2. In general, patterns 41 to 45 are each used independently. Composite embroidery 46 is an example of composite embroidery which is created by combining the patterns 41 to 45. The composite embroidery 46 has an image totally different from a case where the patterns 41 to 45 are each used independently. The sewing machine 1 of the present embodiment can sew the composite embroidery 46 by combining the patterns 41 to 45 through a panel operation.

Figure 3:
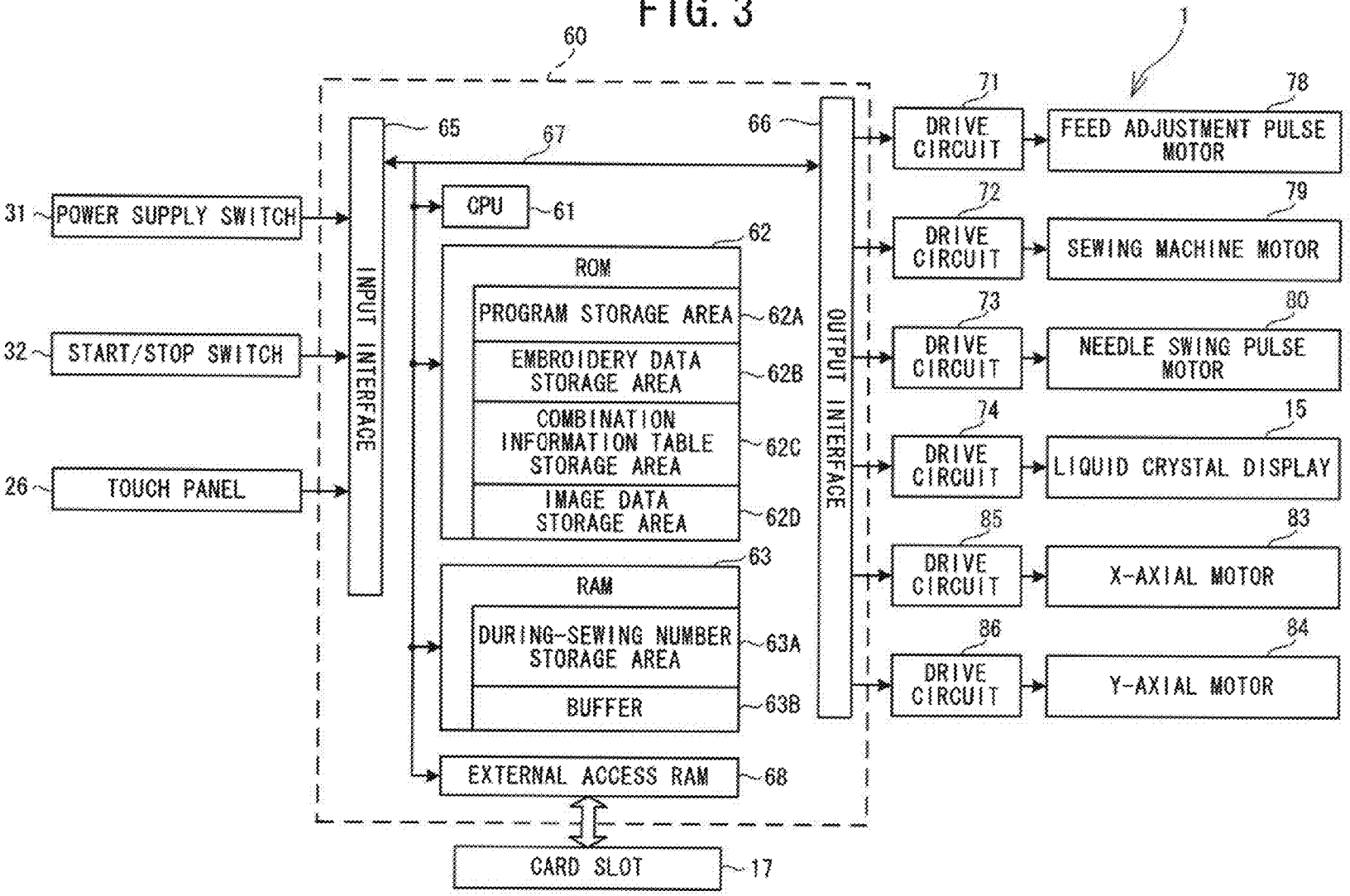
FIG. 3 is a block diagram that shows an electric configuration of the sewing machine 1.

An electrical configuration of the sewing machine 1 will be explained with reference to FIG. 3. A control portion 60 of the sewing machine 1 is provided with a CPU 61, an ROM 62, an RAM 63, an external access RAM68, a card slot 17, an input interface 65, and an output interface 66, all of which are connected to one another by a bus 67. The input interface 65 may be electrically connected to a touch panel 26 and a plurality of operating switches such as a power supply switch 31 and a start/stop switch 32.

The CPU 61 conducts integrated control on operations of the sewing machine 1. The ROM 62 may have a program storage area 62A, an embroidery data storage area 62B, a combination information table storage area 62C, an image data storage area 62D, etc. The program storage area 62A may store various types of programs or the like which are used to control the operations of the sewing machine 1. The embroidery data storage area 62B may store embroidery data of the respective patterns 41 to 45 shown in FIG. 2. Those embroidery data are each an example of embroidery data of various utility stitch patterns and embroidery patterns which can be sewed by the sewing machine 1. The embroidery data denotes a needle drop point at which a sewing needle (not shown) is stuck into the work cloth 100. In some cases, the embroidery data may contain, for example, color thread information which denotes the colors of threads. The combination information table storage area 62C may store combination information tables 21 to 25 (see FIGS. 4 to 8) to be described later. The image data storage area 62D may store image data of various types of images which are displayed on the LCD 15.

The RAM 63 may have a during-sewing number storage area 63A and a buffer 63B. The during-sewing number storage area 63A may store identification numbers of embroidery data which respectively correspond to the patterns 41 to 45 which are being sewed. The buffer 63B may temporarily store data necessary when the CPU 61 controls the sewing machine 1.

The external access RAM68 may be connected to the card slot 17. The card slot 17 is configured to be connected to a memory card (not shown). If the card slot 17 and the memory card may be connected to each other, the sewing machine 1 can read information from the memory card and write information to the memory card.

The output interface 66 is electrically connected to drive circuits 71 to 74, 85, and 86. The drive circuit 71 may drive the feed adjustment pulse motor 78. The drive circuit 72 may drive the sewing machine motor 79. The drive circuit 73 may drive a thread swing pulse motor 80 which drives a needle bar swing mechanism (not shown) swinging the needle bar (not shown). However, neither the feed adjustment pulse motor 78 nor the needle swing pulse motor 80 is driven when the sewing machine 1 sews an embroidery pattern. The drive circuit 74 may drive the LCD 15. The drive circuits 85 and 86 may respectively drive an X-axial motor 83 and a Y-axial motor 84 which are used to transport the embroidery frame 34.

The combination information tables 21 to 25 will be explained with reference to FIGS. 4 to 8. The combination information tables 21 to 25 may store identification numbers, sewing-finished-state information, position information, and combination information in a state where they are correlated with each other. The identification numbers may be used to identify embroidery data. In the present embodiment, the identification number of embroidery data D1 of the pattern 41 is assumed to be D1. The identification number of embroidery data D2 of the pattern 42 is assumed to be D2. The identification number of embroidery data D3 of the pattern 43 is assumed to be D3. The identification number of embroidery data D4 of the pattern 44 is assumed to be D4. The identification number of embroidery data D5 of the pattern 45 is assumed to be D5. For example, the sewing-finished-state information denotes whether sewing of a target pattern is finished. Specifically, if sewing of the target pattern is not finished, the sewing-finished-state information is, for example, set to 0, and if sewing of the target pattern is finished, the sewing-finished-state information is, for example, set to 1. For example, the position information denotes positions of the respective patterns 41 to 45 when sewing the composite embroidery 46. The combination information relate to the embroidery data of a pattern that can be used in combination with the target pattern, for example.

Figure 9:
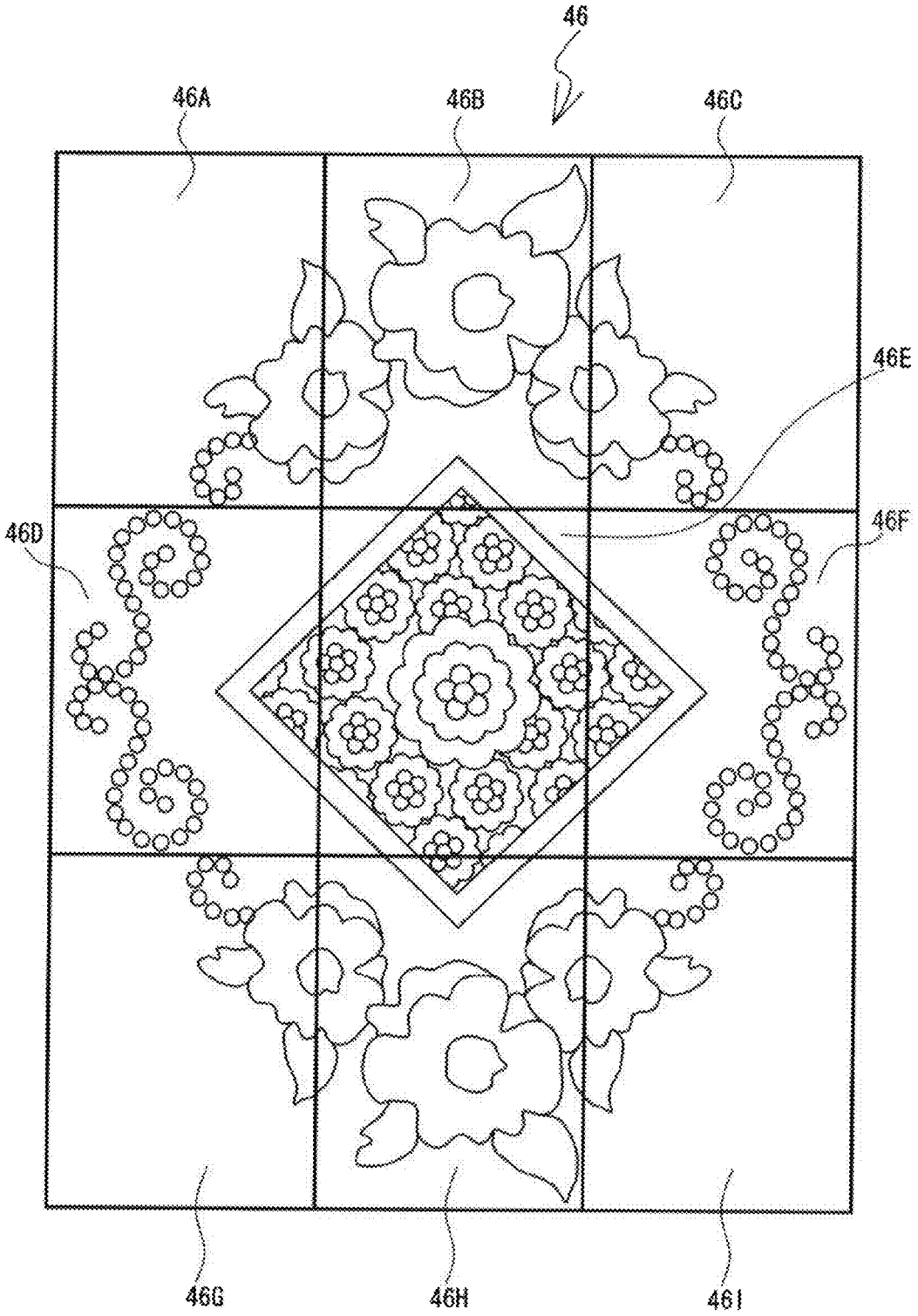
FIG. 9 is an explanatory view showing one example of a sewing area of the composite embroidery 46.

The position information of the patterns 41 to 45 will be explained with reference to FIG. 9. The region of the composite embroidery 46 may be divided into nine areas of an upper left area 46A, an upper middle area 46B, an upper right area 46C, a center left area 46D, a center middle area 46E, a center right area 46F, a lower left area 46G, a lower middle area 46H, and a lower right area 46I. The upper left area 46A denotes an upper portion left side area. The upper middle area 46B denotes an upper portion midsection area. The upper right area 46C denotes an upper portion right side area. The center left area 46D demotes a central portion left side area. The center middle area 46E denotes a central portion midsection area. The center right area 46F denotes a central portion right side area. The lower left area 46G denotes a lower portion left side area. The lower middle area 46H denotes a lower portion midsection area. The lower right area 46I denotes a lower portion right side area. The position information denotes the areas 46A to 46I in which the patterns 41 to 45 shown in FIG. 2 are respectively sewed.

The combination information table 21 shown in FIG. 4 may store various types of information of the pattern 41. The combination information table 21 may store D1 as the identification number, 0 as the sewing-finished-state information, information denoting the upper middle area 46B as the position information, and identification numbers of the embroidery data D2 to D5 as the combination information. D2 to D5 are the respective identification numbers of the patterns 42 to 45 that can be used in combination with the pattern 41.

The combination information table 22 shown in FIG. 5 may store various types of information of the pattern 42. The combination information table 22 may store D2 as the identification number, 0 as the sewing-finished-state information, information denoting the center middle area 46E as the position information, and identification numbers of the embroidery data D1 and D3 to D5 as the combination information. D1 and D3 to D5 are the respective identification numbers of the patterns 41 and 43 to 45 that can be used in combination with the pattern 42.

The combination information table 23 shown in FIG. 6 may store various types of information of the pattern 43. The combination information table 23 may store D3 as the identification number, 0 as the sewing-finished-state information, information denoting the center left area 46D as the position information, and identification numbers of the embroidery data D1, D2, D4, and D5 as the combination information. D1, D2, D4, and D5 are the respective identification numbers of the patterns 41, 42, 44, and 45 that can be used in combination with the pattern 43.

The combination information table 24 shown in FIG. 7 may store various types of information of the pattern 44. The combination information table 24 may store D4 as the identification number, 0 as the sewing-finished-state information, information denoting the lower middle area 46H as the position information, and identification numbers of the embroidery data D1 to D3 and D5 as the combination information. D1 to D3 and D5 are the respective identification numbers of the patterns 41 to 43 and 45 that can be used in combination with the pattern 44.

The combination information table 25 shown in FIG. 8 may store various types of information of the pattern 45. The combination information table 25 may store D5 as the identification number, 0 as the sewing-finished-state information, information denoting the center right area 46F as the position information, and identification numbers of the embroidery data D1 to D4 as the combination information. D1 to D4 are the respective identification numbers of the patterns 41 to 44 that can be used in combination with the pattern 45.

Figure 10:
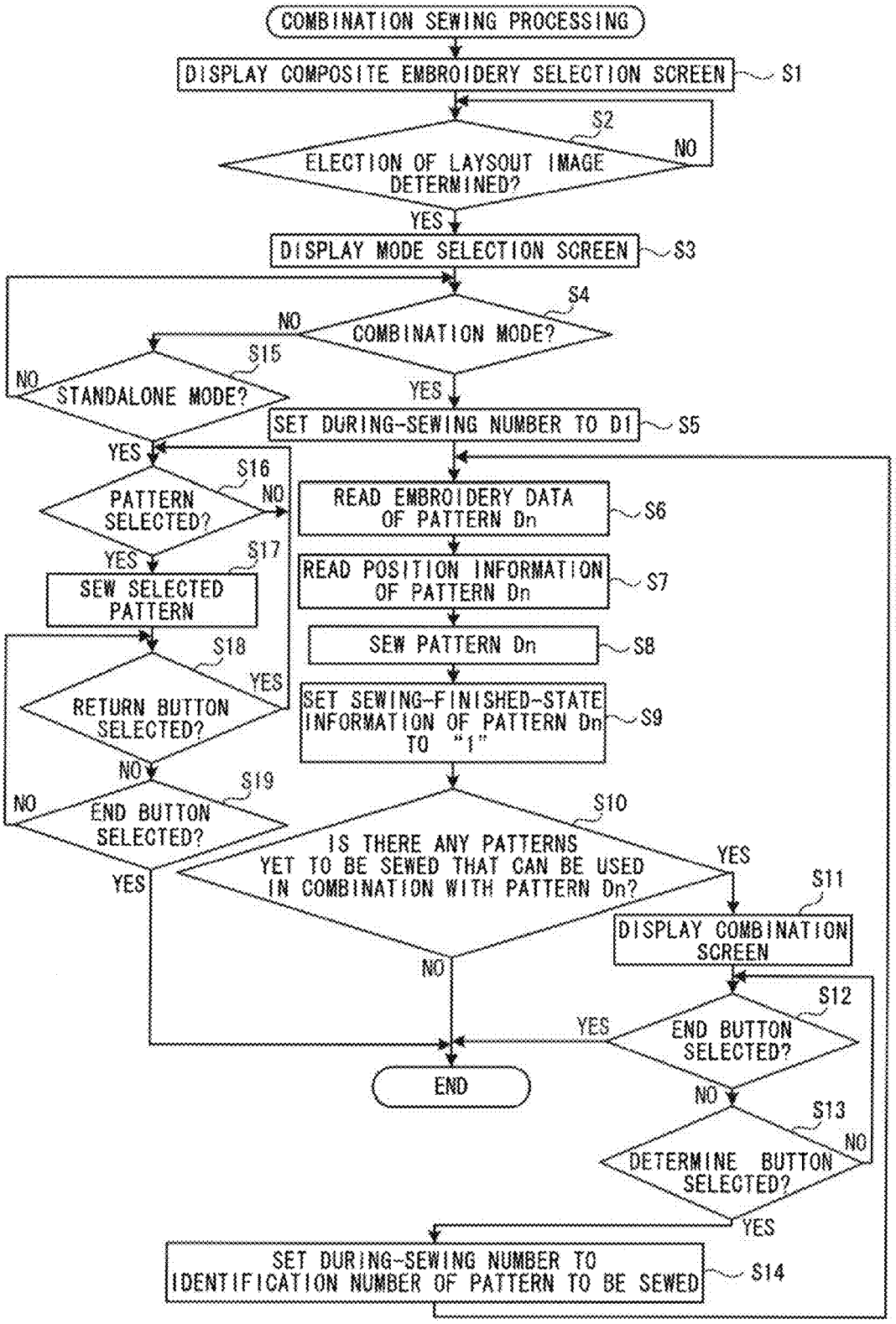
FIG. 10 is a flowchart of combination sewing processing.

With reference to FIG. 10, the combination sewing processing which is performed by the CPU 61 of the sewing machine 1 will be explained. The processing is performed by the CPU 61 by reading a "combination sewing processing program" stored in the program storage area 62A of the ROM 62 if a "combination sewing function" is selected by panel operations by the user.

Figure 11:
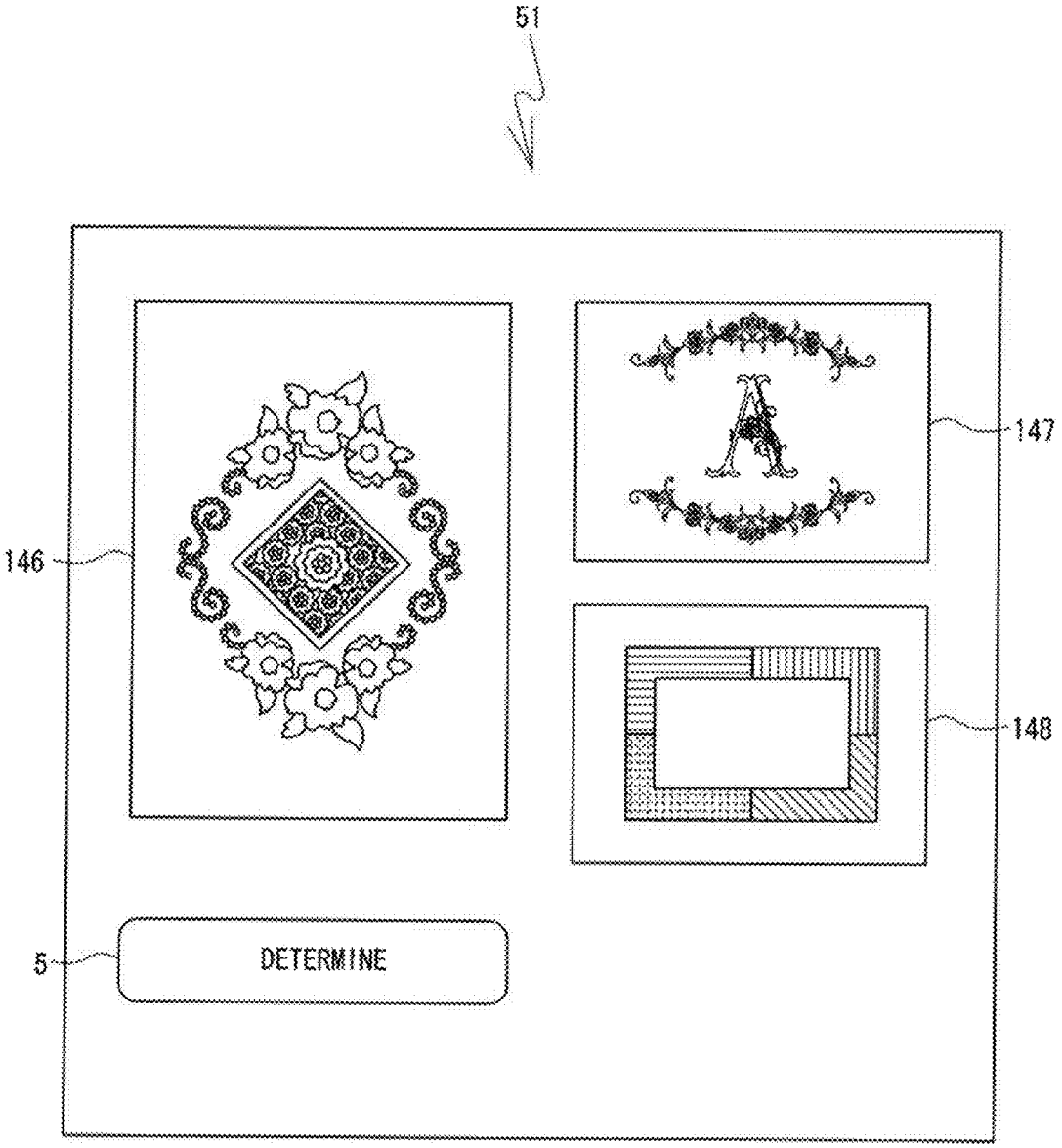
FIG. 11 is an explanatory diagram showing one example of a layout selection screen 51.

First, a layout selection screen (see FIG. 11) is displayed on the LCD 15 by the CPU 61 (step S1). Image data of the layout selection screen 51 is acquired from the image data storage area 62D in the ROM 62. As shown in FIG. 11, layout images 146 to 148 and a DETERMINE button 5 may be displayed on the layout selection screen 51. The layout image 146 may contain the composite embroidery 46 which is created by disposing the patterns 41 to 45. Layout image 147 may contain composite embroidery 47 which is created by disposing a plurality of patterns not shown. Layout image 148 may contain composite embroidery 48 which is created by disposing a plurality of patterns not shown. The DETERMINE button 5 may be used to determine a selection by means of panel operations by the user. For example, the user selects, by touching with his finger, one of the layout images 146 to 148 displayed on the LCD 15 and determines his selection of this layout image by touching the DETERMINE button 5.

Next, the CPU 61 determines whether the selection of the layout image is determined (step S2). Until the selection of the layout image is determined (NO at step S2), the CPU 61 stays in the standby state back in processing in Step S2. If the CPU 61 determines that, for example, the layout image 146 is selected and determined (YES at step S2), a mode selection screen 52 (see FIG. 12) is displayed on the LCD 15 (step S3).

The layout image 146, pattern images 141 to 145, a COMBINE button 6, a STANDALONE button 7, the DETERMINE button 8, and an END button 9 are displayed on the mode selection screen 52. The pattern image 141 denotes the pattern 41. The pattern image 142 denotes the pattern 42. The pattern image 143 denotes the pattern 43. The pattern image 144 denotes the pattern 44. The pattern image 145 denotes the pattern 45. At the left top corner of the pattern image 141, D1 which is the identification number of the embroidery data D1 of the pattern 41 may appear. At the left top corner of the pattern image 142, D2 which is the identification number of the embroidery data D2 of the pattern 42 may appear. At the left top corner of the pattern image 143, D3 which is the identification number of the embroidery data D3 of the pattern 43 may appear. At the left top corner of the pattern image 144, D4 which is the identification number of the embroidery data D4 of the pattern 44 may appear. At the left top corner of the pattern image 145, D5 which is the identification number of the embroidery data D5 of the pattern 45 may appear. The image data of the respective pattern images 141 to 145 on the mode selection screen 52 are acquired from the image data storage area 62D in the ROM 62.

The COMBINE button 6 may be used to set the sewing machine to a combination mode for operations of the sewing machine. The combination mode may be entered to sew the composite embroidery 46 by combining the pattern images 141 to 145. The STANDALONE button 7 may be used to set the sewing machine to a standalone mode for operations of the sewing machine. The standalone mode may be entered to sew independently any one of the pattern images 141 to 145. The DETERMINE button 8 may be used to determine a selection of the mode. The END button 9 may be used to end processing.

Figure 12:
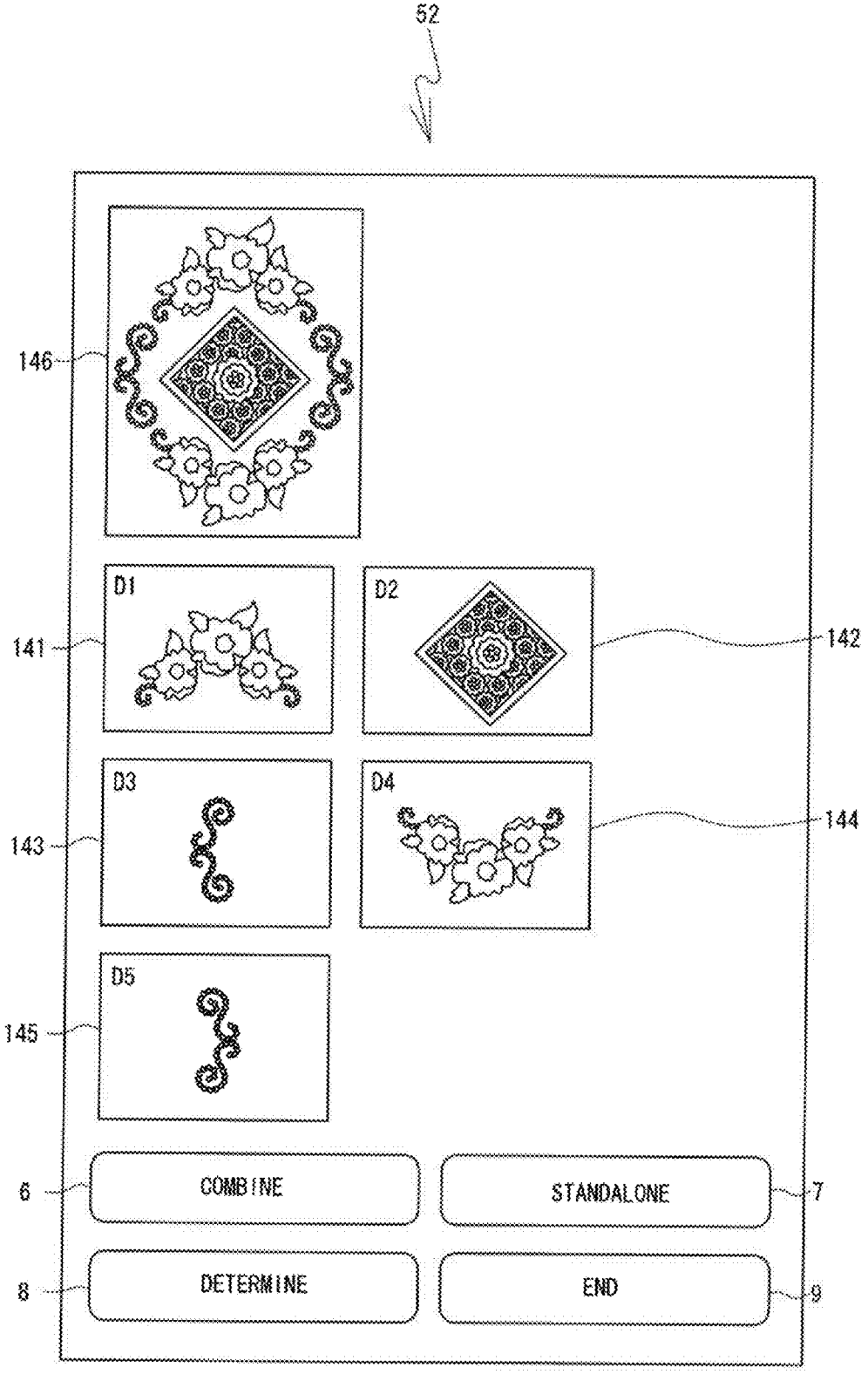
FIG. 12 is an explanatory diagram showing one example of a mode selection screen 52.

The user determines whether he would set the operation mode to the combination mode or the standalone mode by watching the mode selection screen 52 shown in FIG. 12. To set the operation mode to the combination mode, the user selects the COMBINE button 6 and determines the selection with the DETERMINE button 8 through panel operations. To set the operation mode to the standalone mode, the user selects the STANDALONE button 7 and determines the selection with the DETERMINE button 8 through panel operations.

Next, the CPU 61 determines whether the combination mode is selected (step S4). If, for example, the combination mode is selected (YES at step S4), the during-sewing number to be stored in the during-sewing number storage area 63A in the RAM 63 is set to D1 (step S5). Although in the present embodiment, the during-sewing number is automatically set to D1, any other identification number may be set. Further, the user may select the during-sewing number.

The CPU 61 reads the embroidery data D1 of the pattern 41 from the embroidery data storage area 62B in the ROM 62 (step S6). Dn in Step S6 to Step S10 denotes the identification number of a pattern being sewed presently. Therefore, it is known that the pattern being sewed presently is the pattern D1. Moreover, the CPU 61 reads the position information of the pattern 41 by referencing the combination information table 21 (see FIG. 4) stored in the ROM 62 (step S7). As described above, the position information in the combination information table 21 denotes the upper middle area 46B. Therefore, the CPU 61 disposes the embroidery data D1, which has been read, to a position that corresponds to the upper middle area 46B in the buffer 63B in the RAM 63. The CPU 61 disposes the embroidery data D1 by aligning, for example, a center position of the embroidery data D1 with the center coordinates of the upper middle area 46B.

Based on the embroidery data D1 stored in the buffer 63B in the RAM 63, the CPU 61 sews the pattern 41 into the work cloth 100 held by the embroidery frame 34 at the position corresponding to the upper middle area 46B (step S8). Accordingly, the center of the pattern 41 sewed into the work cloth 100 agrees with the center of the upper middle area 46B. If the sewing of the pattern 41 ends, the CPU 61 sets the sewing-finished-state information in the combination information table 21 (see FIG. 4) from 0 to 1 (step S9).

Figure 13:
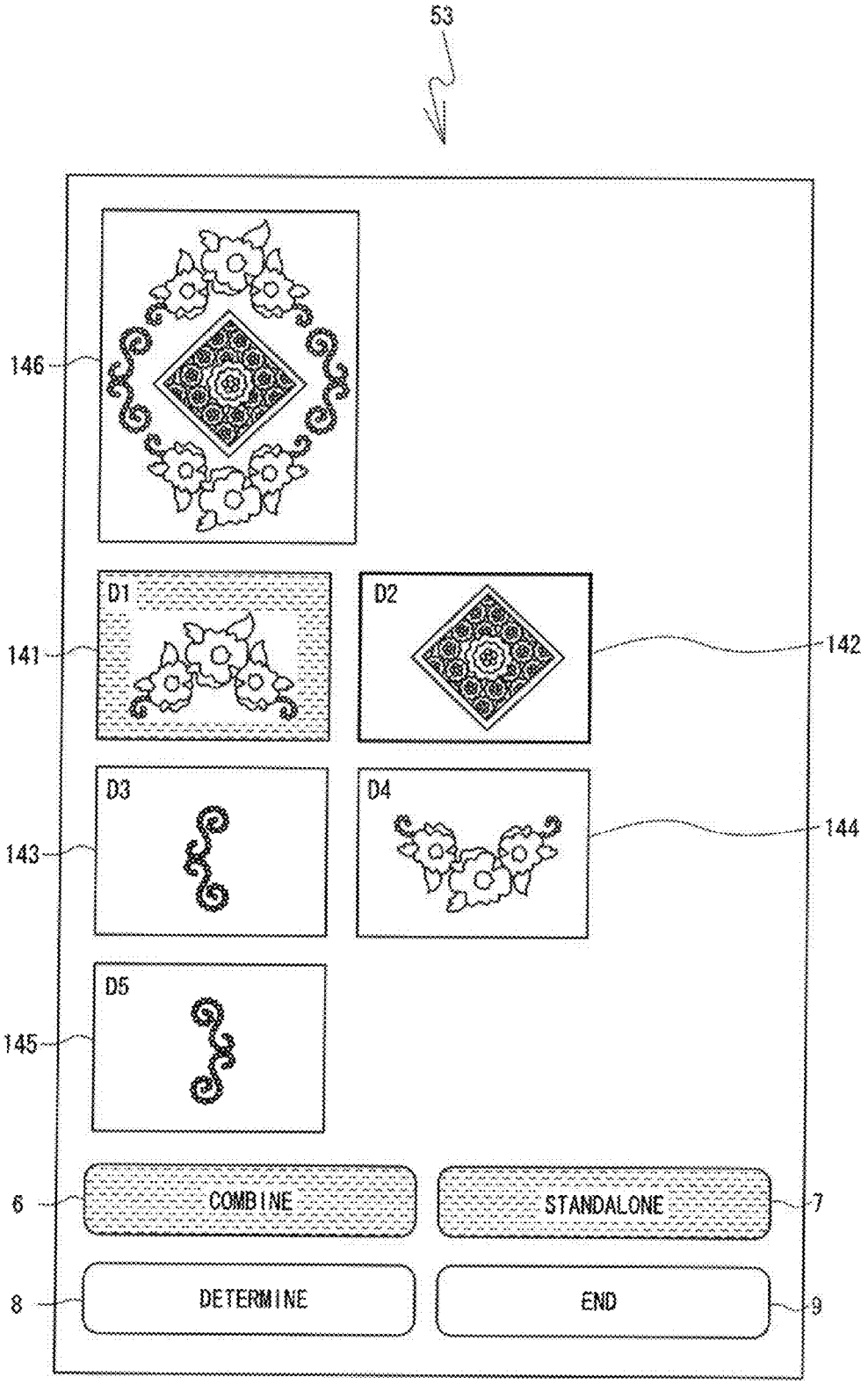
FIG. 13 is an explanatory diagram showing one example of a combination screen 53.

The CPU 61 determines whether there are any patterns yet to be sewed that can be used in combination with the pattern 41 by referencing the combination information stored in the combination information table 21 (step S10). The CPU 61 determines that the embroidery data of the patterns that can be used in combination with the pattern 41 are D2 to D5 by referencing the combination information in the combination information table 21. Therefore, the CPU 61 references the respective sewing-finished-state information of the combination information table 22 corresponding to the embroidery data D2, the combination information table 23 corresponding to the embroidery data D3, the combination information table 24 corresponding to the embroidery data D4, and the combination information table 25 corresponding to the embroidery data D5. By determining whether there is the embroidery data which has the sewing-finished-state information set to 0, the CPU 61 extracts patterns yet to be sewed that can be used in combination with the pattern 41. For example, by referencing the combination information tables 22 to 25 shown in FIGS. 5 to 8, it is known that all of the sewing-finished-state information are set to 0. Therefore, the CPU 61 determines that there are patterns yet to be sewed that can be used in combination with the pattern 41 (YES at step S10) and displays the combination screen 53 shown in FIG. 13 (step S11).

The layout of the combination screen 53 is the same as that of the mode selection screen 52. Since the sewing-finished-state information of the combination information table 21 of the pattern 41 already sewed completely is set to 1, the CPU 61 displays the pattern image 141 in gray and sets the pattern image 141 unselectable. Accordingly, the user knows that the pattern image 141 cannot be selected. Further, as the combination mode is already performed presently, the CPU 61 displays also the COMBINE button 6 and the STANDALONE button 7 for selection of the operation mode in gray similar to the pattern image 141 and sets the COMBINE button 6 and the STANDALONE button 7 unselectable. The user may select a pattern to be sewed from among the pattern images 142 to 145. If the user selects the pattern image 142, for example, the CPU 61 may highlight the selected pattern image 142 by showing an outline of the selected pattern image 142 in bold. The highlighting method is not limited to it; the selected pattern image may totally be displayed brightly. Further, a mark or the like configured to highlight the selected pattern image may be displayed. The user selects one of the pattern images 142 to 145 displayed on the LCD 15 and determines the selection of the pattern image by using the DETERMINE button 5.

The CPU 61 determines whether the END button 9 is selected (step S12). If the CPU 61 determines that the END button 9 is selected (YES at step S12), the CPU 61 ends the combination sewing processing. If the CPU 61 determines that the END button 9 is not selected (NO at step S12), the CPU 61 determines whether one of the pattern images 142 to 145 is selected and determined with the DETERMINE button 8 by the user (step S13). If the CPU 61 determines that it is not determined with the DETERMINE button 8 (NO at step S13), the CPU 61 returns to S12 to repeat the processing. For example, if the CPU 61 determines that the pattern image 142 is selected and determined with the DETERMINE button 8 by the user (YES at step S13), the CPU 61 sets the during-sewing number stored in the during-sewing number storage area 63A in the RAM 63 from D1 to D2, which is the identification number of the pattern D2 shown in the pattern image 142 as a pattern to be sewed next (step S14). The CPU 61 returns the processing to S6 to repeat the processing up to S8 on the embroidery data D2 of the pattern 42.

If the sewing of the pattern 42 ends, the CPU 61 sets the sewing-finished-state information in the combination information table 22 from 0 to 1 (step S9). The CPU 61 determines whether there are any patterns yet to be sewed that can be used in combination with the pattern 42 by referencing the combination information stored in the combination information table 22 (step S10). The combination information in the combination information table 22 are D1 and D3 to D5. Therefore, the CPU 61 determines whether there is embroidery data having the sewing-finished-state information set to 0 by referencing the combination information tables 21 and 23 to 25 that correspond to the embroidery data D1 and D3 to D5 respectively. In this case, as the sewing-finished-state information in each of the combination information tables 23 to 25 is set to 0, the CPU 61 determines that there are patterns yet to be sewed that can be used in combination with the pattern 42 (YES at step S10) and displays the combination screen 53 shown in FIG. 13 on the LCD 15 (step S11). If the pattern image 143 corresponding to the pattern 43 is selected by the user (step S13), the CPU 61 sets the during-sewing number from D2 to D3 (step S14).

Similar to the above, if processing from S6 to S8 is performed until the sewing of the pattern 43 ends, the CPU 61 sets the sewing-finished-state information in the combination information table 23 from 0 to 1 (step S9). The CPU 61 determines whether there are any patterns yet to be sewed that can be used in combination with the pattern 43 by referencing the combination information stored in the combination information table 23 (step S10). The combination information in the combination information table 23 are D1, D2, D4, and D5. Therefore, the CPU 61 determines whether there is embroidery data having the sewing-finished-state information set to 0 by referencing the combination information tables 21, 22, 24, and 25 that correspond to the embroidery data D1, D2, D4, and D5 respectively. In this case, as the sewing-finished-state information in each of the combination information tables 24 and 25 is set to 0, the CPU 61 determines that there are patterns yet to be sewed that can be used in combination with the pattern 43 (YES at step S10) and displays the combination screen 53 shown in FIG. 13 on the LCD 15 (step S11). If the pattern image 144 corresponding to the pattern 44 is selected by the user (step S13), the CPU 61 sets the during-sewing number from D3 to D4 (step S14).

Similar to the above, if processing from S6 to S8 is performed until the sewing of the pattern 44 ends, the CPU 61 sets the sewing-finished-state information in the combination information table 24 from 0 to 1 (step S9). The CPU 61 determines whether there are any patterns yet to be sewed that can be used in combination with the pattern 44 by referencing the combination information stored in the combination information table 24 (step S10). The combination information in the combination information table 24 are D1 to D3 and D5. Therefore, the CPU 61 determines whether there is embroidery data having the sewing-finished-state information set to 0 by referencing the combination information tables 21 to 23 and 25 that correspond to the embroidery data D1 to D3 and D5, respectively. In this case, as the sewing-finished-state information in the combination information table 25 is set to 0, the CPU 61 determines that there are patterns yet to be sewed that can be used in combination with the pattern 44 (YES at step S10) and displays the combination screen 53 on the LCD 15 (step S11). If the pattern image 145 corresponding to the pattern 45 is selected by the user (step S13), the CPU 61 sets the during-sewing number from D4 to D5 (step S14).

Similar to the above, if processing from S6 to S8 is performed until the sewing of the pattern 45 ends, the CPU 61 sets the sewing-finished-state information in the combination information table 25 from 0 to 1 (step S9). The CPU 61 determines whether there are any patterns yet to be sewed that can be used in combination with the pattern 45 by referencing the combination information stored in the combination information table 25 (step S10). The combination information in the combination information table 25 are D1 to D4. Therefore, the CPU 61 determines whether there is embroidery data having the sewing-finished-state information set to 0 by referencing the combination information tables 21 to 24 that correspond to the embroidery data D1 to D4, respectively. In this case, as the sewing-finished-state information in the combination information table 21 to 24 is all set to 1, the CPU 61 determines that there is no patterns yet to be sewed that can be used in combination with the pattern 45 (NO at step S10) and ends the combination sewing processing. In such a manner, it is possible to select and dispose the patterns 41 to 45 on the layout selection screen 51 to create the composite embroidery 46 and sew the composite embroidery 46 into the work cloth 100.

The user can thus sew the composite embroidery 46 speedily without performing troublesome settings or operations each time the patterns 41 to 45 are sewed.

Figure 14:
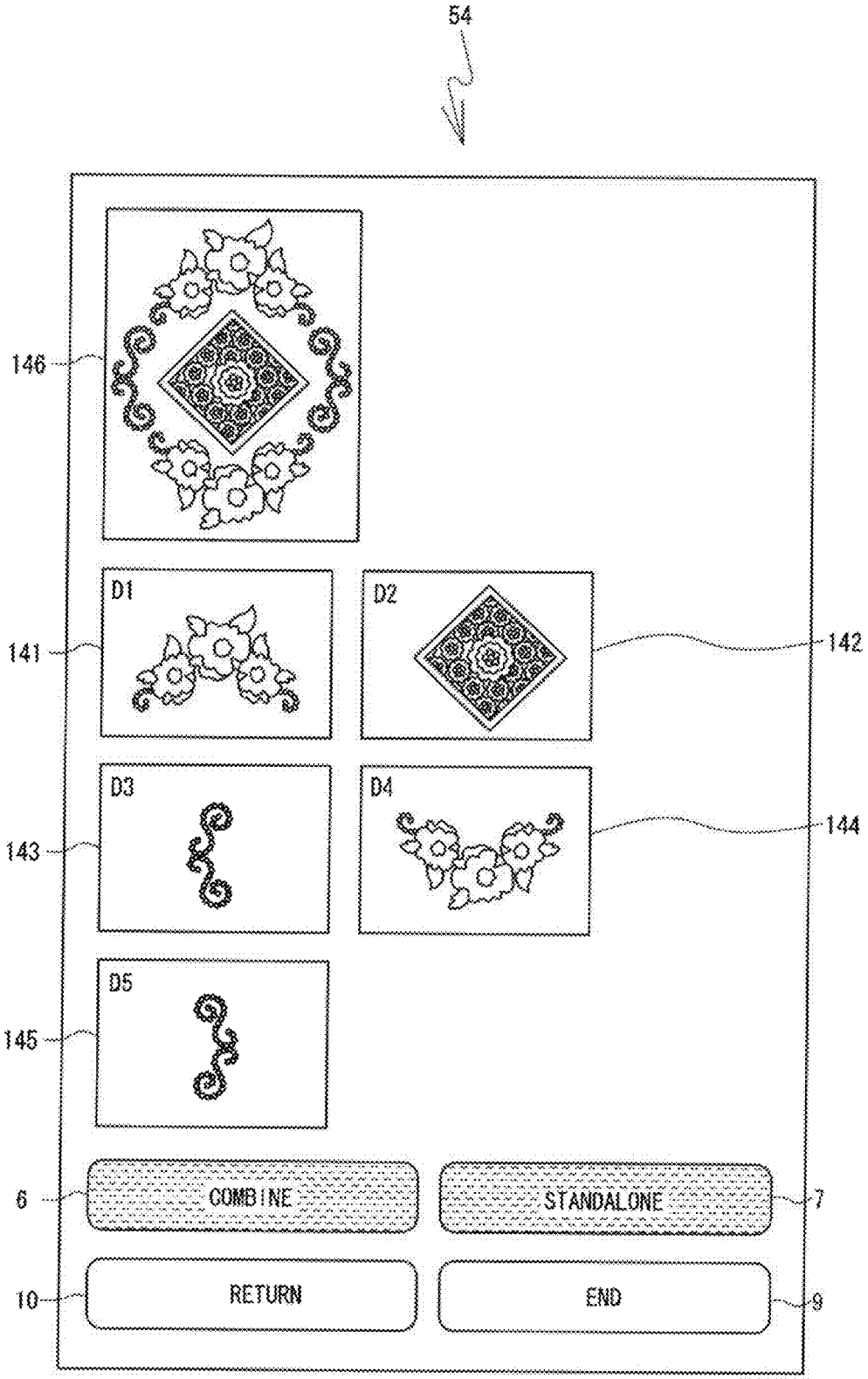
FIG. 14 is an explanatory diagram showing one example of a standalone screen 54.

Further, if the CPU 61 determines that the combination mode is not selected when the mode selection screen 52 is displayed on the LCD 15 (NO at step S4), the CPU 61 determines whether the standalone mode is selected. For example, if the standalone mode is not selected (NO at step S15), the CPU 61 returns to the processing of Step S4 to wait until any one of the COMBINE button 6 and the STANDALONE button 7 is selected (step S4, step S15). If the standalone mode is selected (YES at step S15), the CPU 61 displays the standalone screen 54 shown in FIG. 14 on the LCD 15. The standalone screen 54 is different from the combination screen 53 in that a RETURN button 10 is disposed in place of the DETERMINE button 8 on the combination screen 53. The other layout features are the same as those of the combination screen 53.

If the sewing machine is set to the standalone mode, one of the pattern images 141 to 145 displayed on the standalone screen 54 is selected to sew a pattern that corresponds to this selected pattern image, for example. Before sewing the pattern, the user adjusts the sewing position by moving the embroidery frame 34. If the adjustment of the sewing position is completed, the user selects one of the pattern images 141 to 145 displayed on the LCD 15 and sews a pattern of the selected pattern image. If the sewing of this pattern is completed, the user can select another one from the pattern images 141 to 145 and sew the selected pattern image continually. The user can also end the sewing. In contrast to a case where the sewing machine is set to the combination mode, in the case where the sewing machine is set to the standalone mode, the user can sew the patterns 41 to 45 respectively corresponding to the pattern images 141 to 145 at his desired positions, for example. The same pattern consecutively can be also sewn using the sewing machine set to the standalone mode.

The CPU 61 determines whether any pattern to be sewed is selected (step S16). If, for example, the pattern image 141 is selected by the user through panel operations (YES at step S16), the CPU 61 sews the pattern 41 into the work cloth 100 held by the embroidery frame 34 based on the embroidery data D1 stored in the buffer 63B of the RAM 63 (step S17). The sewing position is adjusted by the user beforehand. For example, the user can move the embroidery frame 34 to a desired position by operating the embroidery frame transport device 33. Consequently, the user can adjust the sewing position on the work cloth 100 held by the embroidery frame 34. Conversely, if no pattern to be sewed is selected (NO at step S16), the CPU 61 returns to the processing of Step S16 to wait until the user selects any one of the pattern images 141 to 145.

The CPU 61 determines whether the RETURN button 10 is selected (step S18). If the RETURN button 10 is selected by the user through panel operations (YES at step S18), the CPU 61 returns to the processing of Step S16 to wait until a pattern is selected. For example, to sew the pattern 43 next to the pattern 41, the user can select the pattern image 143 through panel operations and sew the pattern 43 corresponding to the pattern image 143 into the work cloth 100 held by the embroidery frame 34 by using the sewing machine 1.

If the CPU 61 determines that the RETURN button 10 is not selected (NO at step S18), the CPU 61 decides whether the END button 9 is selected (step S19). If the CPU 61 determines that the END button 9 is not selected (NO at step S19), the CPU 61 returns to the processing of S18. The CPU 61 waits until the user selects either the RETURN button 10 or the END button 9 and determines the selection by the DETERMINE button 8 (step S18, step S19). Conversely, if it is determined that the END button 9 is selected (YES at step S19), the CPU 61 completes the sewing in the standalone mode and ends the combination sewing processing.

As described hereinabove, by the sewing machine 1 of the present embodiment, it is possible to sew the patterns 41 to 45 in combination with each other to create the composite embroidery 46. For example, in the case of sewing the pattern 41 first by using the sewing machine 1, if the sewing of the pattern 41 is completed, the CPU 61 in the sewing machine 1 references the combination information table 21 to thereby extract the embroidery data that corresponds to patterns yet to be sewed that can be used in combination with the pattern 41. In this case, the CPU 61 extracts the embroidery data that corresponds to the patterns 42 to 45. Next, the pattern 42 is sewed with the sewing machine 1. If the sewing of the pattern 42 is completed, the CPU 61 references the combination information table 22 to thereby extract the embroidery data that corresponds to patterns yet to be sewed that can be used in combination with the pattern 42. In this case, the CPU 61 extracts the embroidery data that corresponds to the patterns 43 to 45. Next, the pattern 43 is sewed with the sewing machine 1. If the sewing of the pattern 43 is completed, the CPU 61 references the combination information table 23 to thereby extract the embroidery data that corresponds to patterns yet to be sewed that can be used in combination with the pattern 43. In this case, the CPU 61 extracts the embroidery data that corresponds to the patterns 44 and 45. Next, the pattern 44 is sewed with the sewing machine 1. If the sewing of the pattern 44 is completed, the CPU 61 references the combination information table 24 to thereby extract the embroidery data that corresponds to patterns yet to be sewed that can be used in combination with the pattern 44. In this case, the CPU 61 extracts the embroidery data that corresponds to the pattern 45. Next, the pattern 45 is sewed with the sewing machine 1. If the sewing of the pattern 45 is completed, the CPU 61 references the combination information table 25 to thereby extract the embroidery data that corresponds to patterns yet to be sewed that can be used in combination with the pattern 45. In this case, since the patterns 41 to 45 have already been sewed, no embroidery data is extracted that corresponds to patterns yet to be sewed that can be used in combination with the pattern 45. By sewing the patterns 41 to 45 in this order, the composite embroidery 46 is formed on the work cloth 100. As described above, in a case where the user sews a plurality of independent embroidery patterns in combination with each other, combinations of the plurality of independent embroidery patterns are identified on the basis of the combination information. Therefore, it is possible to speedily sew embroidery patterns without performing troublesome settings or operations such as determining sewing positions with reference to a mark denoting a reference position formed on the work cloth for each of the embroidery patterns.

Further, in the present embodiment, for example, in the case of sewing the pattern 42, the user can sew the composite embroidery 46 speedily without performing operations or settings such as adjustment of a position where the pattern 42 is sewed or edition of the embroidery data D2 corresponding to the pattern 42. Further, by sewing a combination of the patterns 41 to 45 each of which is already decorative and valuable as an embroidery pattern, the user can sew the more decorative composite embroidery 46. Further, by displaying a selected embroidery pattern and specific embroidery patterns that can be used in combination with this embroidery pattern on the LCD 15, the user can visually recognize the selected embroidery pattern and specific embroidery patterns.

Note that the present disclosure is not limited to the present embodiment that has been described above, and various types of modifications may be made. The sewing machine 1 may be used to create the composite embroidery 46 in the combination mode. Although the composite embroidery pattern 46 is a combination of the patterns 41 to 45 shown in FIG. 2, it may be a pattern that takes on the shape of a character.

Further, although in the above embodiment the composite embroidery 46 is divided into nine sewing areas as a result of being horizontally and vertically divided into three each, it may be divided into a plurality of sewing areas which form a horizontal line.

Further, although in the above embodiment the composite embroidery 46 is divided into nine sewing areas as a result of being horizontally and vertically divided into three each, it may be divided into a plurality of sewing areas which form a vertical line.

Further, although in the above embodiment the composite embroidery 46 is divided into nine sewing areas, the number of divisions is not limited to nine.

What is claimed is:

1. A sewing machine comprising:

a processor; and a memory configured to store a plurality of embroidery data which respectively corresponds to a plurality of embroidery patterns and computer-readable instructions that instruct the sewing machine to execute steps comprising:

selecting one of the plurality of embroidery data;

sewing the embroidery pattern corresponding to the selected embroidery data;

extracting, from the plurality of embroidery data, specific embroidery data, wherein the specific embroidery data is usable in combination with the selected embroidery data; and sewing the specific embroidery pattern based on the extracted specific embroidery data.

2. The sewing machine according to claim 1, wherein the memory is further configured to store combination information denoting specific embroidery data, wherein the specific embroidery data is usable in combination with the selected embroidery data;

wherein the computer-readable instructions further instruct the sewing machine to execute step comprising:

extracting the specific embroidery data which is usable in combination with the selected embroidery data, based on the combination information.

3. The sewing machine according to claim 2, wherein the combination information includes position information which identities a position of sewing based on the specific embroidery data;

wherein the computer-readable instructions further instruct the sewing machine to execute step comprising:

sewing the specific embroidery pattern at the position.

4. The sewing machine according to claim 1, further comprising:

a display device, wherein the computer-readable instructions further instruct the sewing machine to execute step comprising:

displaying, on the display device, the embroidery pattern which corresponds to the selected embroidery data and the specific embroidery pattern which corresponds to the extracted specific embroidery data.

5. An information processing apparatus comprising:

a processor; and a memory configured to store a plurality of embroidery data which respectively correspond to a plurality of embroidery patterns and computer-readable instructions that instruct the information processing apparatus to execute steps comprising:

selecting one of the plurality of embroidery data; and extracting, from the plurality of embroidery data, specific embroidery data, wherein the specific embroidery data is usable in combination with the selected embroidery data.

6. The information processing apparatus according to claim 5, wherein the memory is further configured to store combination information denoting specific embroidery data, wherein the specific embroidery data is usable in combination with the selected embroidery data;

wherein the computer-readable instructions further instruct the information processing apparatus to execute step comprising:

extracting the specific embroidery data which is usable in combination with the selected embroidery data, based on the combination information.

7. A non-transitory computer-readable medium storing computer-readable instructions that instruct an information processing apparatus to execute steps comprising:

selecting one of a plurality of embroidery data which respectively correspond to a plurality of embroidery patterns; and extracting, from the plurality of embroidery data, specific embroidery data, wherein the specific embroidery data is usable in combination with the selected embroidery data.

8. The non-transitory computer-readable medium according to claim 7, wherein a memory of the information processing apparatus is further configured to store combination information denoting specific embroidery data, wherein the specific embroidery data is usable in combination with the selected embroidery data, wherein the computer-readable instructions further instruct the information processing apparatus to execute step comprising:

extracting the specific embroidery data which is usable in combination with the selected embroidery data, based on the combination information.

* * * * *